US007753734B2

(12) United States Patent
Eckel et al.

(10) Patent No.: US 7,753,734 B2
(45) Date of Patent: Jul. 13, 2010

(54) CABLE TERMINAL DEVICE FOR TRANSMITTING ELECTRICAL DRIVE POWER

(75) Inventors: Markus Eckel, Bürstadt (DE); Wolfgang Maier, Moerfelden-Walldorf (DE); Markus Bahr, Affalterbach (DE); Peter Bormuth, Heppenheim (DE); Christoph Kraemer, Weinheim (DE); Josef Woller, Griesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/279,450

(22) PCT Filed: Feb. 8, 2007

(86) PCT No.: PCT/EP2007/001059

§ 371 (c)(1), (2), (4) Date: Aug. 14, 2008

(87) PCT Pub. No.: WO2007/093316

PCT Pub. Date: Aug. 23, 2007

(65) Prior Publication Data

US 2009/0017685 A1 Jan. 15, 2009

(30) Foreign Application Priority Data

Feb. 18, 2006 (DE) ..... 10 2006 007 604

(51) Int. Cl.
*H01R 9/03* (2006.01)

(52) U.S. Cl. ..... 439/607.41; 439/98; 439/584

(58) Field of Classification Search ..... 439/607.41, 439/607.42, 607.44, 607.45, 607.5, 607.51, 439/607.52, 95, 98, 584, 585
See application file for complete search history.

(56) References Cited

U.S. PATENT DOCUMENTS

| | | | | |
|---|---|---|---|---|
| 3,668,612 | A * | 6/1972 | Nepovim | 439/584 |
| 5,662,495 | A | 9/1997 | Inaba et al. | |
| 6,406,329 | B1 | 6/2002 | Lazzaro, Jr. | |
| 7,048,586 | B2 * | 5/2006 | Ishizaki et al. | 439/607.44 |
| 7,357,672 | B2 * | 4/2008 | Montena | 439/584 |
| 7,540,775 | B2 * | 6/2009 | Eckel et al. | 439/587 |

FOREIGN PATENT DOCUMENTS

| | | |
|---|---|---|
| CA | 2096710 | 11/1994 |
| DE | 19936508 A1 | 3/2001 |

* cited by examiner

*Primary Examiner*—Hae Moon Hyeon
(74) *Attorney, Agent, or Firm*—Barley Snyder, LLC

(57) ABSTRACT

A terminal device has a housing of insulating material, the housing surrounding a portion of the cable end of a sleeve and having a flange directed towards a terminal receptacle. There is additionally provided an inner shield sleeve of conductive material arranged in the housing and surrounding the cable, the inner shield sleeve is connected conductively to a shield of the cable and which has a flanged contact zone directed towards the terminal receptacle. Fastening screws are used simultaneously to press the housing and the flanged contact zone, resting on the housing, of the inner shield sleeve axially against a shield housing of the terminal receptacle.

8 Claims, 4 Drawing Sheets

CABLE TERMINAL DEVICE FOR TRANSMITTING ELECTRICAL DRIVE POWER

CROSS-REFERENCE TO RELATED APPLICATIONS

This application claims the benefit of the earlier filed International Patent Application No. PCT/EP2007/001059 having a filing date of Feb. 8, 2007, and that claims the benefit of the earlier filed German Patent Application No. DE 10 2006 007 604.4 having a filing date of Feb. 18, 2006.

FIELD OF THE INVENTION

The invention relates to a terminal device for transmitting electrical drive power for a motor vehicle between a terminal receptacle and a shielded cable, and more particularly to an electrical connection arrangement having at least one such terminal device.

BACKGROUND

For the purposes of the present patent application, an electrical terminal device is an electrical component for firm or permanent connection to a cable and configured to releasably connect with a mating component. The mating component of the terminal device is called the terminal receptacle and the mating component of the terminal receptacle is called the terminal device.

In electrical engineering and electronics, a large number of terminal devices and associated mating components, in particular a large number of very different plug connectors and plug receptacles are available. These serve to transmit electrical power and/or electrical signals with the widest possible range of voltages, currents, frequencies and data rates. To prevent the emission or coupling-in of electromagnetic interference, the complementary terminals may be provided with single or multiple shielding in accordance with the cables or other transmission elements connected therewith. To protect against damp, dusty, or chemically aggressive environments, terminal devices and terminal receptacles comprise a very wide range of sealing elements. Screw fittings or latch fittings may serve to prevent separation of terminal devices and terminal receptacles. The actual current-carrying connections may be produced, for example, by a plug-in connection or by screwing a cable lug crimped onto the cable together with a screwable terminal or contact provided in the terminal receptacle. Due to the extremely wide range of applications and conditions of use, a wide variety of optimized complementary terminal elements are available.

A relatively new field of use for terminal devices and terminal receptacles is the transmission of drive power in an electrically driven motor vehicle. This drive power is transmitted between an energy storage means, for example a storage battery, a fuel cell, a generator, or other energy source, a power converter and one or more drive motors in one direction or alternating in both directions. In particular, between the power converter and the drive motor(s), the drive power may be transmitted in pulse width-modulated manner and thus with a high A.C. component. Cables or leads with shielding are used to prevent the emission of electromagnetic interference signals.

Motor vehicles with an electromotive drive existed until recently only in the form of prototypes or short run models. For this reason, the terminal devices and terminal receptacles which have been used in the power transmission area are those which are readily available but are distinguished for the most part by a robust but also very complex structure. These terminal devices and terminal receptacles are therefore complex and expensive to produce and assemble.

With electrically driven motor vehicles moving into the realms of series and mass production, the demands placed on the terminals in the power transmission area are also changing. They not only have to be robust and ensure long-term, malfunction-free functioning over the entire life of the motor vehicle, but also have to be simple and cheap to produce and assemble. One of these new demands is the desire to avoid the very high plug-in forces which arise with the plug-in connectors used hitherto due to the large lead cross-sections and the associated contact sizes. These assembly forces cannot be sufficiently reduced by assembly aids such as levers. In addition, assembly aids require a very large structural space.

An object of the present invention is to provide a completely sealed (shield and conductor) terminal device for a shielded cable, which allows simple, cheap production and reliable, low-force assembly on connection with a terminal receptacle.

SUMMARY

The present invention is based on the concept of using a housing of insulating material, which surrounds a portion of the cable end in the manner of a sleeve and which comprises a flange directed towards the terminal receptacle, simultaneously for securing against separation of terminal device and terminal receptacle and for reliable shield continuity. To this end, an inner shield sleeve and a fastening means are provided. The inner shield sleeve is constructed of conductive material arranged in the housing and surrounding the cable, which sleeve is connected conductively to the shield and which comprises a flanged contact zone directed towards the terminal receptacle. The fastening means enables the housing and the contact zone of the inner shield sleeve resting on the housing to be simultaneously pressed axially against a conductive shield housing of the terminal receptacle. This construction results in a shielded terminal device for high voltages and currents, which may advantageously be used in hybrid and fuel cell vehicles. The terminal device according to the invention may be plugged or screwed into the terminal receptacle for current-carrying connection and is distinguished by low plug-in forces, a small structural space, and the possibility a single pole or multipole configuration.

An outer shield sleeve surrounding the cable may be provided to improve the contact stability of the shield connection, said outer shield sleeve being arranged in the housing and pushed onto a cable-side end of the inner shield sleeve, the (exposed) shield of the cable being fixed by clamping between the inner and outer shield sleeves. In an embodiment which is regarded as particularly advantageous, the outer shield sleeve takes the form, on the cable side, of insulation crimping for the cable and, in the area of clamping fixing of the shield of the cable, of shield crimping. In this way, strain relief of the outer sheath of the cable is combined with shield crimping. Furthermore, a projection may be incorporated into the shield crimping for making possible oriented preassembly of the parts relative to one another.

The terminal device according to the invention makes possible the simple incorporation of a highly effective sealing arrangement, the particular advantage of which is that the seals, consisting for example of non-conductive silicone (or another non-conductive sealing material), may be fitted in protected manner in the housing and therefore cannot be damaged.

This sealing arrangement comprises, on the cable side, a seal and a covering cap which surround the cable, in each case, in the manner of sleeves, the seal being introduced, in particular press-fitted, into the cable-side end of the housing and the covering cap surrounding the cable-side end of the housing provided with the seal in the manner of a cap and being capable of being latched to the housing. On the opposite side of the terminal device, sealing may be achieved by providing a second sleeve-shaped sealing means which is screwed onto a shoulder of the housing formed in the area of the flange in such a way that it rests sealingly between the shoulder and a sealing face formed on the terminal receptacle upon fastening the terminal device to the terminal receptacle.

To improve shield continuity contact stability with regard to the shield housing, it is advantageous for the contact zone of the inner shield sleeve to comprise contact points and/or disc-shaped or arm-shaped contact means. Due to the terminal device structure selected according to the invention, relatively large design latitude is thus possible with regard to shield continuity.

In an exemplary embodiment, the fastening means provided for mechanical connection of the terminal device and the terminal receptacle comprises at least one fastening screw arranged axially in the area of the housing flange. Alternatively, at least one axially arranged snap-action hook may be provided as a fastening means in the area of the housing flange.

Since the insulating housing of the terminal device according to the invention is of sleeve-shaped construction, a cable lug crimped onto the cable may be provided to simply produce the current-carrying connection, where the cable lug comprises a terminal part directed towards the terminal receptacle and the terminal part is capable of being screwed together with the current-carrying part of the terminal receptacle.

The connection arrangement according to the invention for producing releasable electrical connections between at least one cable and at least one terminal receptacle comprises one terminal device of the above-described type designed for modular side-by-side arrangement for each cable. In this respect, it is advantageous to construct the terminal receptacles associated with the terminal devices with a common shield housing, in which the individual current-carrying parts are arranged next to one another and against which the terminal device housings, which are optionally resting against one another in modular manner, may be jointly pressed.

BRIEF DESCRIPTION OF THE DRAWINGS

Exemplary embodiments of the present invention are explained below with reference to the drawings, in which.

DETAILED DESCRIPTION OF THE EMBODIMENT(S)

Figure 1:
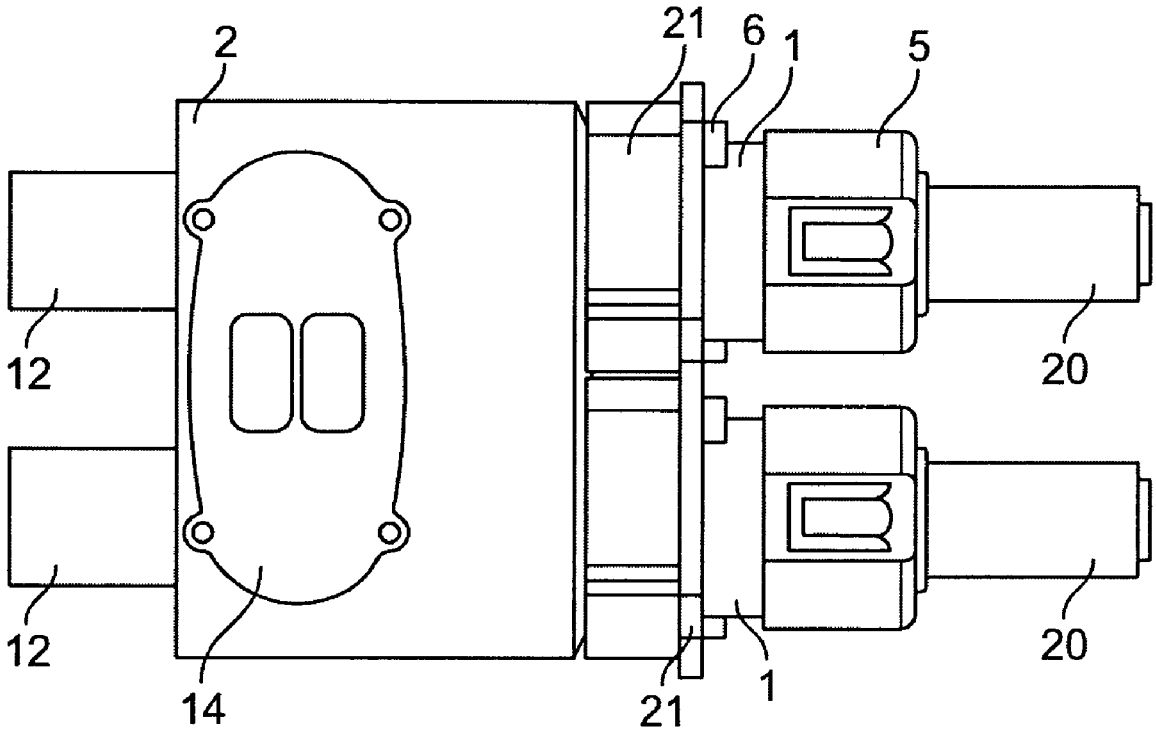
FIG. 1 is a schematic plan view of an electrical connection arrangement.

FIG. 1 is a schematic plan view of a connection arrangement for connecting two cables 20 to two conductor bars 12 by means of two terminal devices (terminals) according to the invention. The terminal devices are prepared as modular constructions, at least regarding their housing 1 and, in particular, regarding the box-shaped flange 21, such that the terminal devices are arranged side-by-side, as illustrated. The terminal receptacles take the form, substantially, of the conductor bars 12, which are accommodated in a common shield housing 2 of conductive material. Each terminal device is attached to the shield housing 2, for example, by at least one screw 6, in the axial direction predetermined by the cable 20 or the associated housing 1, the housing 1 being pressed against conductive contact surfaces of the shield housing 2 on the shield housing side, i.e. in the area of the flange 21. The terminal device additionally comprises a sleeve-shaped sealing means 3, which is formed in the area of the flange 21 and screwed onto a shoulder 40 of the housing 1 in such a way that, upon fastening the terminal device to the terminal receptacle, the sealing means 3 rests sealingly between the shoulder 40 and a sealing face 42 formed on the terminal receptacle.

Figure 2:
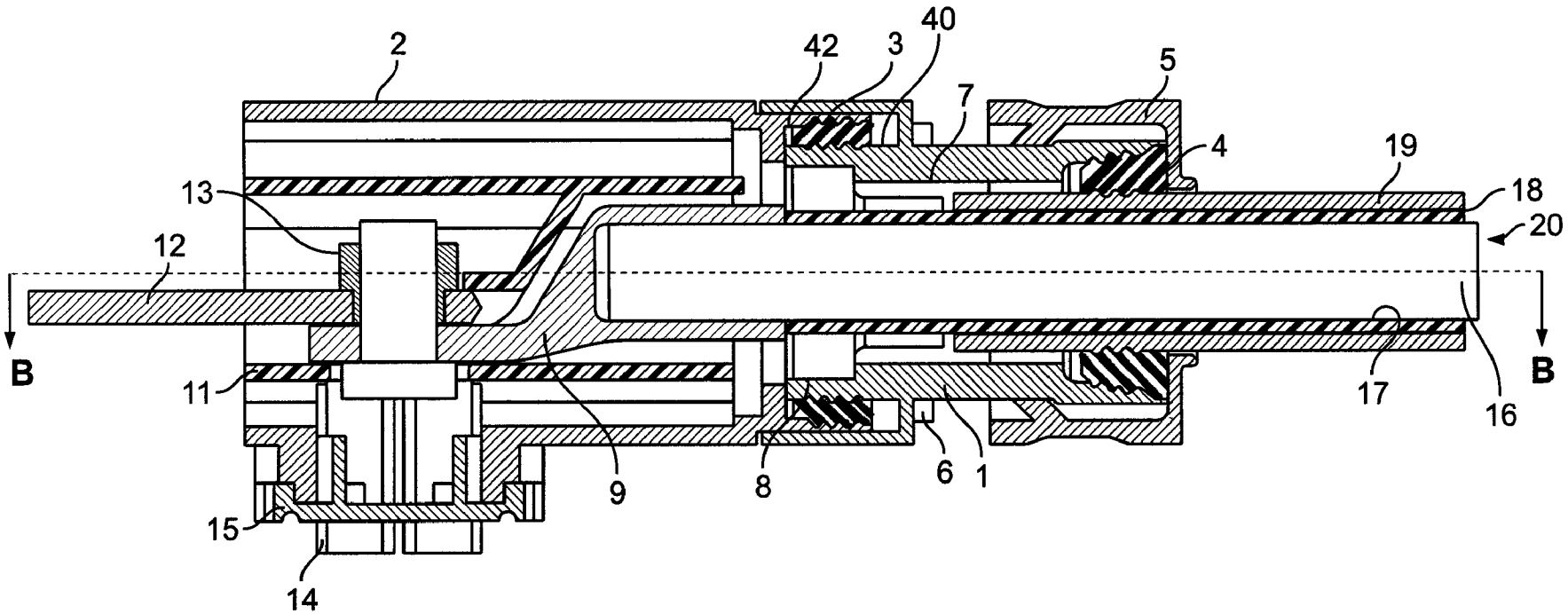
FIG. 2 is a schematic sectional representation of the connection arrangement.

In the sectional representation according to FIG. 2, it is clear, first of all, that the cable 20 comprises the inner conductor 16, the inner insulation 17, the shield (shielding braid) 18, and the outer insulation 19. The shield 18 is clamped firm between inner shield sleeve 8 and outer shield sleeve 7, as also shown in the illustration according to FIG. 3. The outer shield sleeve 7 may take the form, on the cable side, of strain-relieving insulation crimping for the cable 20 and at the same time, in the area where the shield 18 of the cable 20 is clamped firm, of shield crimping.

The inner shield sleeve 8 has the function of contacting the shield 18 with the shield housing 2. As is clear, in particular in the enlarged representation according to FIG. 3, the inner shield sleeve 8, which is optionally repeatedly offset as illustrated, rests with its flanged contact zone 22 on the housing 1, which is non-conductive.

The contact zone 22 of the inner shield sleeve 8 may comprise circumferential contact points, for example, in order to ensure reliable contacting with the associated contact surface 23 of the shield housing 2. In another possible construction of the contact zone 22, the latter takes the form, for example, of a fan-type disc or a corrugated disc or has contact arms, wherein said elements may in each case be constructed with or without contact points.

One or more fastening screws 6 are used to press the housing 1 and the contact zone 22 of the inner shield sleeve 8 against the shield housing 2, so ensuring an elevated contact pressure and high vibration resistance. If requirements are not so stringent, the screws 6 may be replaced by one or more snap-action hooks (not shown), which goes hand-in-hand, of course, with significantly greater ease of assembly. When the housings 1 are arranged next to one another, they rest against one another in the area of the flange 21. The housing 1 and the shield housing 2 are advantageously in each case so designed that the housing 1 can only be assembled in one position. In addition, both housings 1 and 2 may comprise coding. Not least, it is advantageous that the flange 21 does not itself have to have a conductive coating, despite being functionally incorporated into the shield connection.

Figure 3:
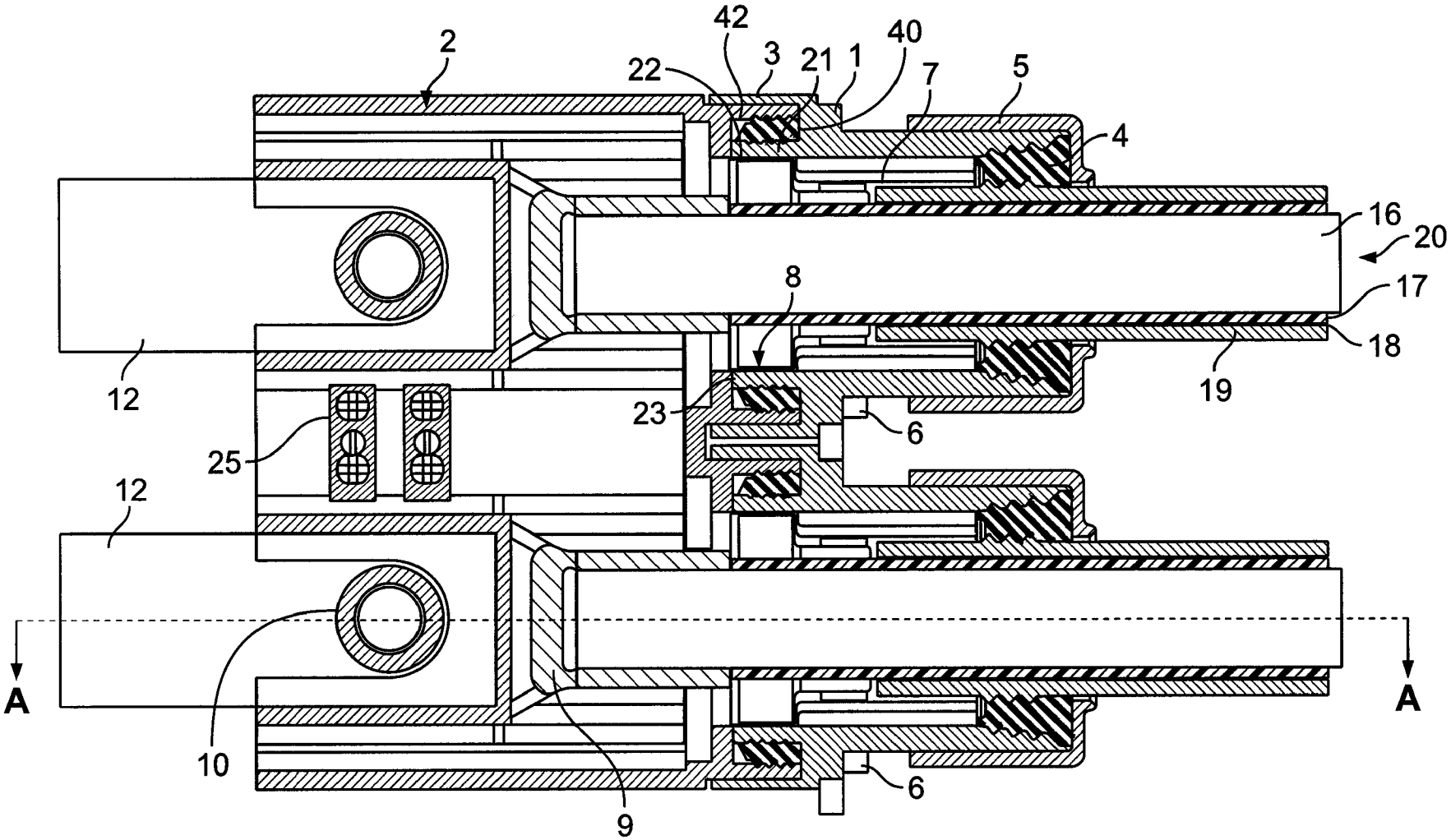
FIG. 3 is a further schematic sectional representation of the connection arrangement (on an enlarged scale)

The cable lug 9 crimped onto the inner conductor 16, as shown in FIGS. 2 and 3, comprises an elongate hole in the screw area for a terminal part 10 for example, for compensating axial tolerances. (Instead of an elongate hole, a larger opening may also be provided.) On assembly, the cable lug 9 is introduced into the shield housing 2, wherein it may be positioned relative to the conductor bar 12 via the insulation 11 serving as an assembly aid. At the same time, the insulation 11 serves as a torque bracket and positioning means for the conductor bar 12. In the case of readily accessible shield housings 2, such a positioning aid is not necessary, and orientation may instead be undertaken simply by hand. The assembly access cover 14 with the cover seal 15 ensures access to the screw connection 13. In the case of readily accessible screw connections 13, the assembly access cover 14 may be dispensed with. The cable lug 9 may also be connected to the inner conductor 16 other than by crimping, or a cable lug 9 may be wholly omitted, for instance by making the inner conductor 16 screwable by compacting welding with regard to the respective mating terminal component of the terminal receptacle. Moreover, FIG. 3 shows an interrupt device 25 for safety shutdown through interruption of the signal circuit, which may be implemented in the context of the terminal device according to the invention.

Figure 4:
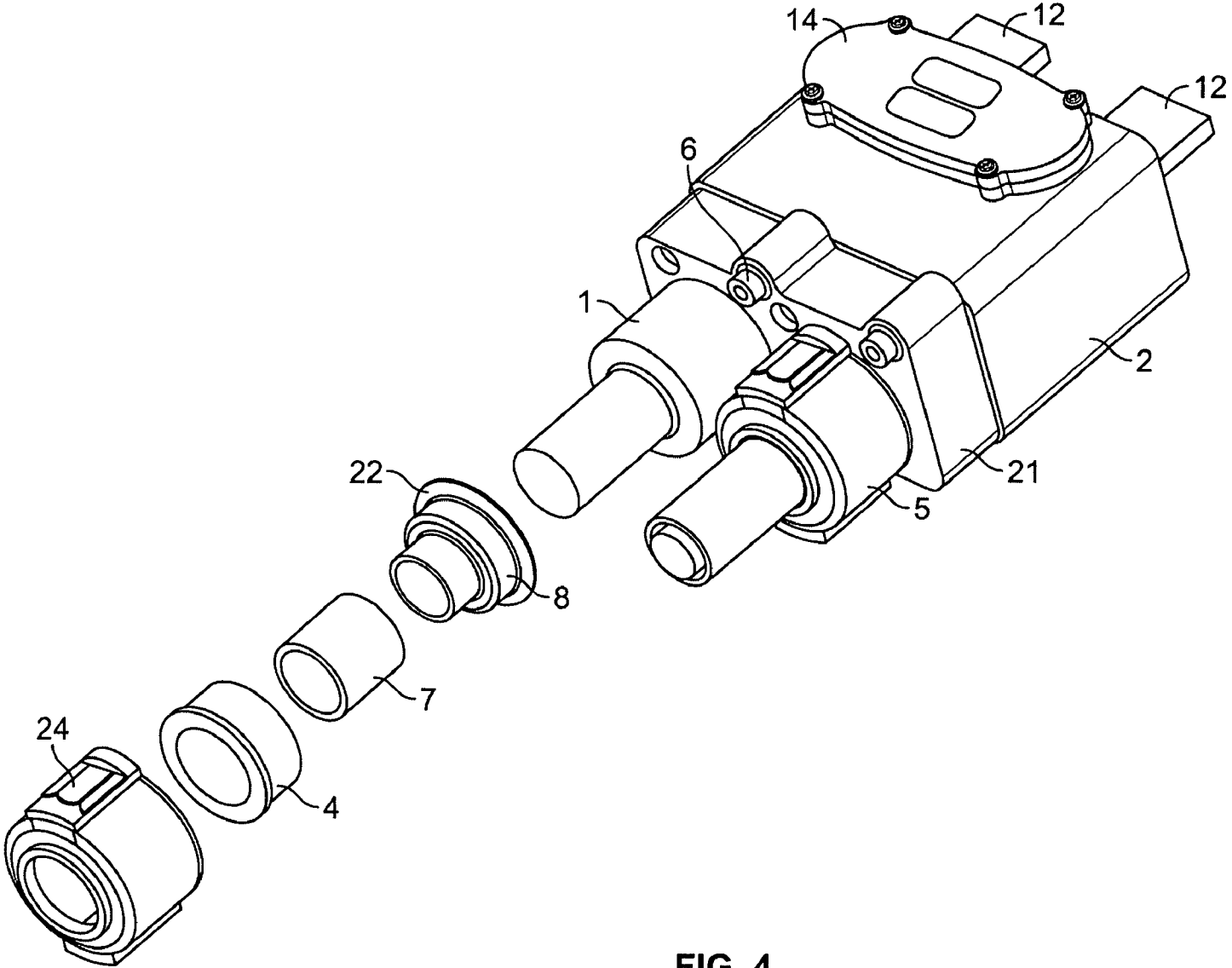
FIG. 4 is a view of the connection arrangement in partially exploded representation.

FIG. 4 shows a perspective view of a connection arrangement, in which the inner shield sleeve 8, the outer shield sleeve 7, the seal 4, press-fittable into the cable-side end 30 of the housing 1 and provided with sealing lips for example, and the covering cap 5 with latching closure 24 are shown in exploded representation to make them clearer to understand. Equally possible are embodiments (not shown) in which the shield housing 2 is reduced substantially to the end plate directed towards the flanges 21 of the housing 1, such that the connection arrangement may be incorporated virtually directly, for example into a motor housing. In this case, the length of the connection arrangement is only approximately 60 mm, whilst it is approximately twice that of the shield housing 2. The contact spacing of the current-carrying conductors 9 or 12 amounts, in the exemplary embodiment shown, to approximately 51 mm.

The invention claimed is:

1. A cable terminal device comprising:

a housing of insulating material, which surrounds an end portion of a cable in the form of a sleeve and which comprises a flange directed towards a terminal receptacle;

an inner shield sleeve of conductive material arranged in the housing and surrounding the cable, the inner shield sleeve being connected conductively to a shield of the cable and having a flanged contact zone directed towards the terminal receptacle;

an outer shield sleeve surrounding the cable, the outer shield sleeve being arranged in the housing and being pushed onto a cable-side end of the inner shield sleeve, the shield of the cable being fixed by clamping between the inner and outer shield sleeves; and fasteners, by which the housing and the flanged contact zone of the inner shield sleeve, resting on the housing, simultaneously press axially against a conductive shield housing of the terminal receptacle.

2. The cable terminal device according to claim 1, wherein the outer shield sleeve takes the form, on the cable side, of insulation crimping for the cable and, in the area where the shield of the cable is clamped firm, of shield crimping.

3. The cable terminal device according claim 2, wherein a sealing arrangement is provided, which comprises a seal and a covering cap, which surround the cable, the inner shield sleeve, the outer shield sleeve, and the seal being press-fitted into the cable-side end of the housing and the covering cap surrounding the seal and the cable-side end of the housing, the covering cap capable of being latched to the housing.

4. The cable terminal device according to claim l, wherein a second sleeve-shaped seal is provided, which is screwed in such a way onto a shoulder of the housing formed in the area of the flange that it rests sealingly between the shoulder and a sealing face formed on the terminal receptacle on fastening an inner conductor of the cable to the terminal receptacle.

5. The cable terminal device according to claim 1, wherein the flanged contact zone of the inner shield sleeve comprises contact points and/or disc-or arm-shaped contacts.

6. The cable terminal device according to claim 1, wherein at least one fastening screw arranged axially in the area of the flange of the housing is provided as a fastener.

7. The cable terminal device according to claim 1, wherein at least one snap-action hook arranged axially in the area of the flange of the housing is provided as a fastener.

8. The cable terminal device according to claim 1, wherein a cable lug crimped onto the cable comprises a terminal part directed towards the terminal receptacle, the terminal part configured to connect with a current-carrying part of the terminal receptacle in a screw area.

* * * * *